US006290512B1

(12) United States Patent
Mullen, Jr.

(10) Patent No.: US 6,290,512 B1
(45) Date of Patent: Sep. 18, 2001

(54) PREMOLD WITH COVERED CRIMP

(75) Inventor: Thomas M. Mullen, Jr., Dunellen, NJ (US)

(73) Assignee: Hayco, Inc., Toms River, NJ (US)

( * ) Notice: Subject to any disclaimer, the term of this patent is extended or adjusted under 35 U.S.C. 154(b) by 0 days.

(21) Appl. No.: 09/569,666

(22) Filed: May 12, 2000

Related U.S. Application Data

(60) Provisional application No. 60/150,366, filed on Aug. 24, 1999.

(51) Int. Cl.[7] ..... H01R 4/66
(52) U.S. Cl. ..... 439/106; 439/606; 439/686
(58) Field of Search ..... 439/106, 606, 439/696, 686, 687, 645, 906, 701, 752, 598

(56) References Cited

U.S. PATENT DOCUMENTS

| | | | | |
|---|---|---|---|---|
| 4,846,723 | | 7/1989 | Pong | 439/456 |
| 4,921,454 | * | 5/1990 | Atherton et al. | 439/686 |
| 5,219,304 | | 6/1993 | Lin | 439/461 |
| 5,603,638 | | 2/1997 | Brown et al. | 439/106 |
| 5,647,751 | | 7/1997 | Shulman et al. | 439/106 |
| 6,109,975 | * | 8/2000 | Nitta | 439/596 |

FOREIGN PATENT DOCUMENTS

| | | | | |
|---|---|---|---|---|
| 403222271-A | * | 10/1991 | (JP) | 439/686 |
| 405029038-A | * | 2/1993 | (JP) | 439/686 |
| 406203914-A | * | 7/1994 | (JP) | 439/686 |

* cited by examiner

*Primary Examiner*—Tho D. Ta
(74) *Attorney, Agent, or Firm*—Selitto, Behr & Kim

(57) ABSTRACT

A premold for housing the electrical contacts of an electrical connector has a base with a plurality of channels extending from a front surface to a rear surface thereof, each of the channels accommodating therein an associated electrical contact. An intermediate wall extending transversely across each of the channels divides them into a front portion extending from the front surface to the intermediate wall and a rear portion extending from the intermediate wall to the rear surface. The front portion of each channel accommodates an engageable portion of the electrical contact and the rear portion accommodates a connector end of the electrical contact for connecting it to an electrical cord. The front portion and the rear portion of the channels shield the electrical contacts from inadvertent contact. A cover snaps on to the base covering the front portion and the rear portion of each of the channels and the electrical contacts contained therein for retaining the electrical contacts within the housing insulated from contacting each other and from contacting the environment. The cover is substantially coextensive with the base portion such that each of the electrical contacts is substantially completely contained within the premold.

8 Claims, 5 Drawing Sheets

PREMOLD WITH COVERED CRIMP

CROSS REFERENCE TO RELATED APPLICATION

This is a §111(a) application relating to U.S. application Ser. No. 60/150,366 filed Aug. 24, 1999.

FIELD OF THE INVENTION

The present invention relates to plugs and receptacles for use in conjunction with electrical cords and cables and more particularly to molded terminal assemblies having open and closed positions to accommodate and contain electrical contacts therein which are usable with or without overmolding.

BACKGROUND OF THE INVENTION

Electrical plugs and receptacles for removably connecting conductor sets are ubiquitous. Various plug and receptacle designs have been proposed over the years primarily directed to promoting ease of manufacture by way of automated assembly, the preservation of the integrity of the plug/receptacle and separation of the electrical conductors over the useful life thereof. In particular, plural parallel electrical conductors must be maintained in insulated relationship such that shorts are avoided. Because plugs and receptacles are frequently exposed to mechanical stresses, they are frequently overmolded with a flexible elastomer such that they can be stepped on or dropped without breaking. In order to improve the integrity of the plug, that is the isolation of the contacts, and to provide a strong mechanical support for the contacts such that they can flex and press against a mating electrical contact, rigid premold assemblies have been utilized for holding the electrical contacts in a selected position. The premolds are then overcoated with an elastomer to provide additional insulation and also to provide the required protection from mechanical shocks and stresses.

To facilitate automated production, prior art premolds frequently utilized electrical conductors that extended beyond the rear surface of the premold to allow crimping of the conductors to a wire set (see, for example, U.S. Pat. Nos. 5,603,638 and 5,647,751). The crimps could be faced in the same direction facilitating the automated crimping of the electrical connectors to the wires. Such designs required overmolding in that the crimp area of the electrical conductors was exposed and needed the overmolding as insulation. Furthermore, in order to prevent shorts, exposed crimp areas had to be monitored through quality assurance measures to maintain separation of any stray wires that may inadvertently extend from one terminal to another.

It therefore remains an objective in the art to provide improved insulation and separation of conductor sets and attached wires in the manufacture of electrical plugs and receptacles and, in particular, those using premolds. It continues to remain an objective in the art to provide plugs and receptacles that are mechanically strong and that resist breakage from the stresses and strains that they may be subjected to in the environment. In this regard, it is especially desirable to have multipart premolds that do not become disassembled when subjected to mechanical forces. The present invention is intended to meet the foregoing objectives.

SUMMARY OF THE INVENTION

The limitations and disadvantages of the prior art are overcome by the present invention which includes a premold for housing the electrical contacts of an electrical connector. The premold has a base with a plurality of channels extending from a front surface to a rear surface thereof, each of the channels accommodating therein an associated electrical contact. The front surface is that surface of the premold that is proximate to a mating electrical connector when the electrical connector is used for making an electrical connection. An intermediate wall extending transversely across each of the channels divides them into a front portion extending from the front surface to the intermediate wall and a rear portion extending from the intermediate wall to the rear surface. The front portion of each channel accommodates an engageable portion of the electrical contact and the rear portion accommodates a connector end of the electrical contact for connecting it to an electrical cord. The front portion and the rear portion of the channels shield the electrical contacts from inadvertent contact with the environment from a first direction.

A cover fitting over the base covers the front portion and the rear portion of each of the channels and the electrical contacts contained therein for retaining the electrical contacts within the housing insulated from contacting each other and from contacting the environment from a second direction. The cover is substantially coextensive with the base portion such that each of the electrical contacts are substantially completely contained within the premold.

BRIEF DESCRIPTION OF THE DRAWINGS

For a better understanding of the present invention, reference is made to the following detailed description of an exemplary embodiment considered in conjunction with the accompanying drawings, in which.

DESCRIPTION OF THE PREFERRED EMBODIMENTS

Certain basic principles pertaining to the fabrication of premolds, electrical contacts and overmolding are known in the art, for example, as shown in U.S. Pat. No. 5,603,638 to Brown et al., and assigned to the Assignee of the present application, such patent being incorporated by reference herein for its teachings concerning the production of electrical receptacles.

Figure 1:
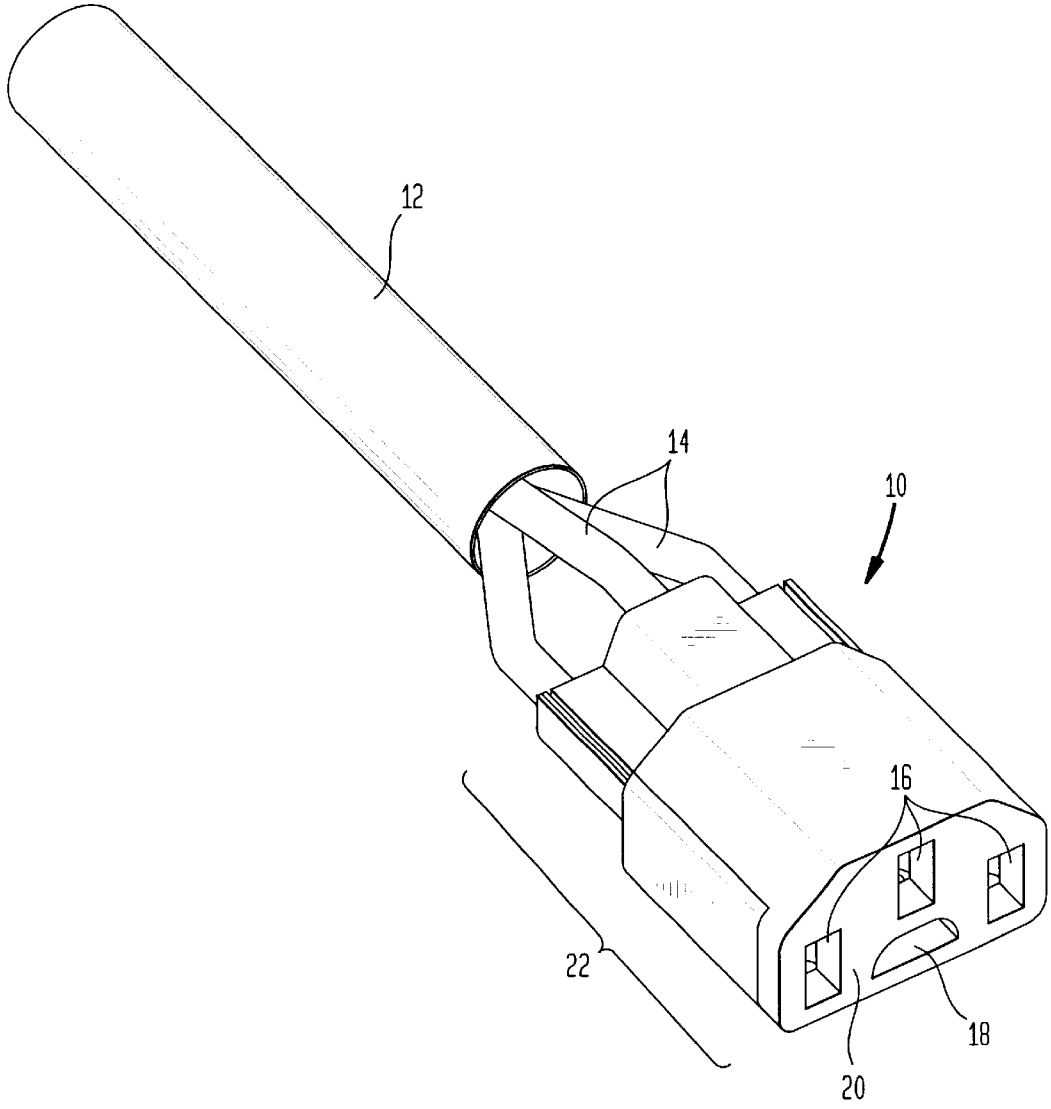
FIG. 1 is a perspective view of a receptacle in accordance with an exemplary embodiment of the present invention.

FIG. 1 shows a female electrical connector in the form of a receptacle 10 attached to an electrical cable 12 having a plurality of wires 14, for example as used for the electrical supply of a computer, the cable having positive, negative and ground connections. The receptacle 10 has a plurality of blade apertures 16, in this instance configured in a generally triangular configuration with the ground contact at the top and the positive and negative contacts at either side. While a three contact, female receptacle is used to explain the present invention, the invention is not restricted to female electrical receptacles and is equally applicable to the construction of male electrical plugs and to receptacles and plugs with various numbers of conductor elements, as shall be evident from the description below.

The receptacle 10 has an overmold inflow aperture 18 in the front face 20 thereof to allow overmolding material, such as an elastomer, to flow into the aperture 18, thereby providing integrity between the premold receptacle 10 and the overmolding material (not shown). While the receptacle 10 is described herein as being a premold suitable for an anticipated overmolding of elastomer, such as rubber or vinyl, the present invention is not intended to be restricted to use as a premold and, for certain applications, the receptacle can be utilized without overmolding. In this regard, it should be noted that the body 22 of the receptacle 10 completely covers the electrical contacts, the crimped portion of the electrical contacts and the bared portions of the wires 14, thereby enabling use without an overmolding layer.

Figure 2:
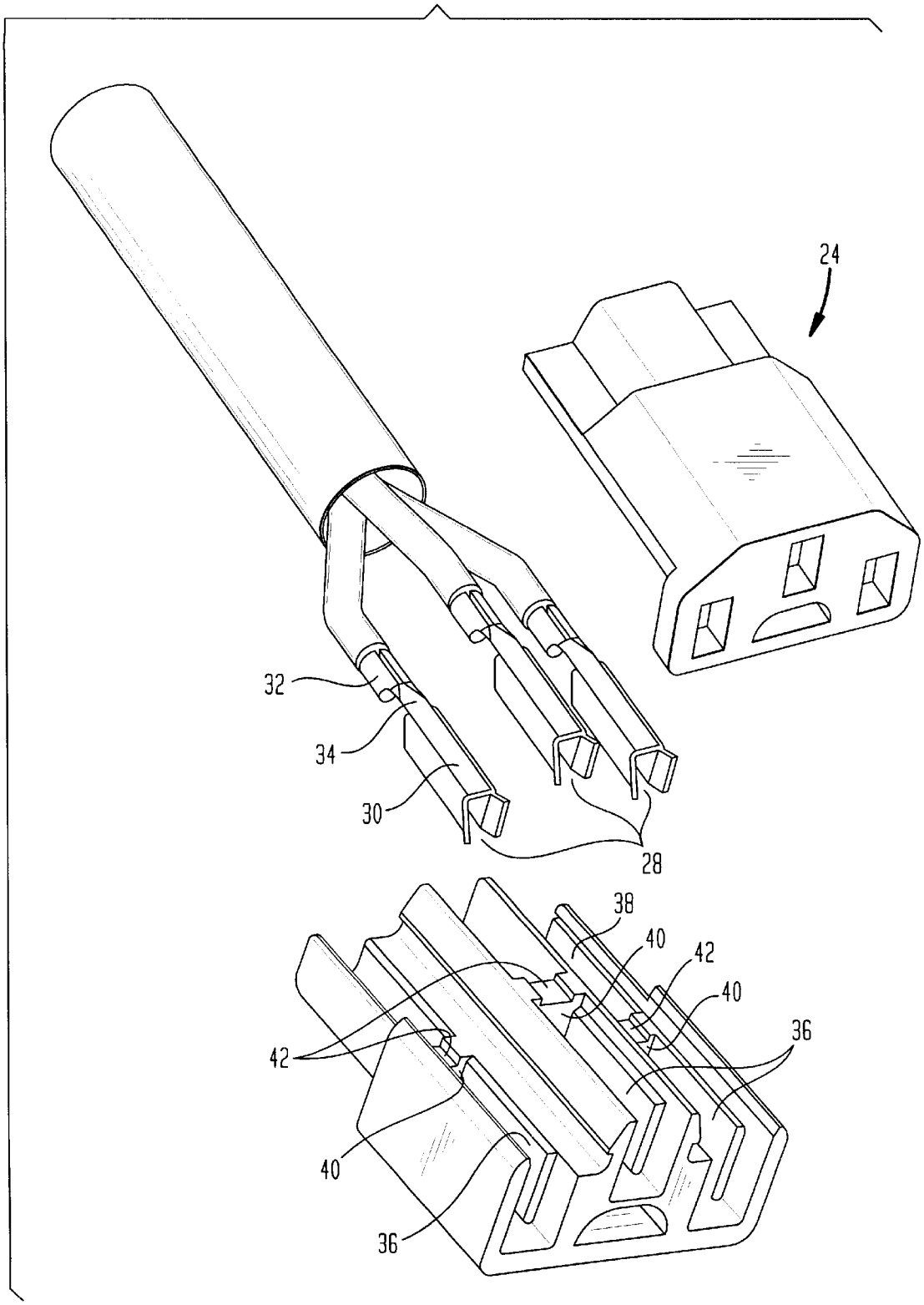
FIG. 2 is an exploded view of the receptacle of FIG. 1.

FIG. 2 shows that the receptacle 10 includes a top portion 24 and a bottom portion 26 which snap-fit together to form the receptacle 10. A plurality of electrical contacts 28 are accommodated within the receptacle 10 between the top and bottom portions 24, 26. The electrical contacts 28 have an engageable gripping portion 30, a wire crimp or connector end portion 32 and a flat bridge portion 34 therebetween. Each gripping portion 30 is accommodated within an associated channel 36 in the front of the bottom portion 26 of the receptacle 10. Each crimp portion 32 is housed within an associated channel 38 located toward the rear of the bottom portion 26 of the receptacle 10. Divider walls 40 separate the front channels 36 from the rear channels 38. The bridge portion 34 of each electrical contact 28 passes from the front channel 36 to the rear channel 38 via a relief 42 provided on the upper surface of an associated wall 40. When the top portion 24 is assembled to the bottom portion 26, the electrical contacts 28 are rigidly held within the receptacle 10 by virtue of the complimentary shape of the channels 36, 38 and reliefs 42 with respect to the electrical contacts 28, namely the gripping portions 30, the crimp portions 32 and the bridge portions 34.

Figure 3:
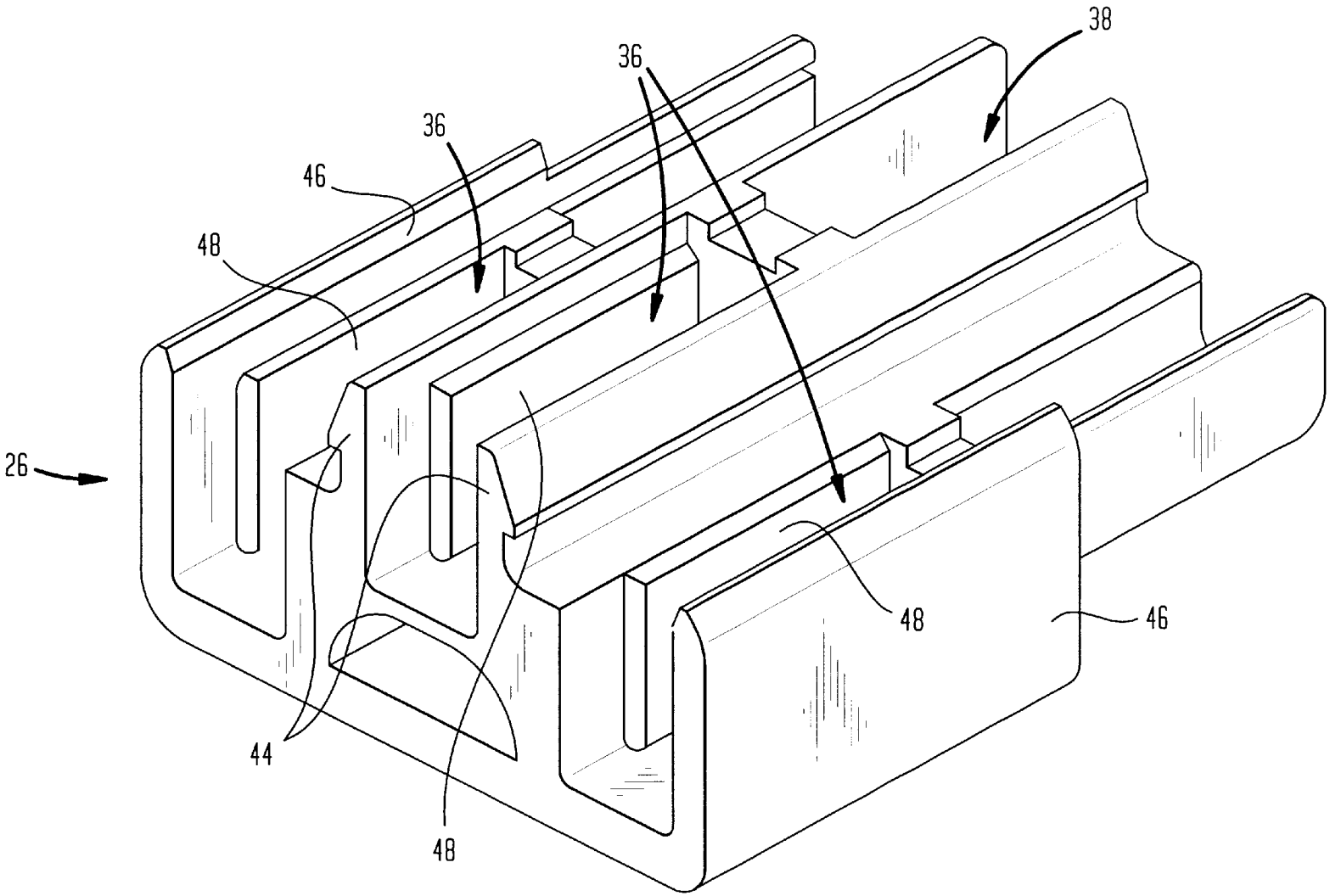
FIG. 3 is an enlarged perspective view of the bottom portion of the receptacle shown in FIG. 1.

FIG. 3 shows the bottom portion 26 in greater detail including a pair of opposed locking ridges 44 extending from the central (i.e., ground) channels 36, 38. As will be appreciated from FIG. 5, the locking ridges 44 are received within mating channels (see FIG. 5) in the top portion 24 of the receptacle 10 to retain the top and bottom portions together. In FIG. 3, the bottom portion 26 has a pair of side walls 46 for lockably engaging the top portion 24 as shall be described below. Supports 48 are provided on opposite sides of the channels 36 for mechanically constraining the gripping portion 30 of the electrical contacts 28.

Figure 4:
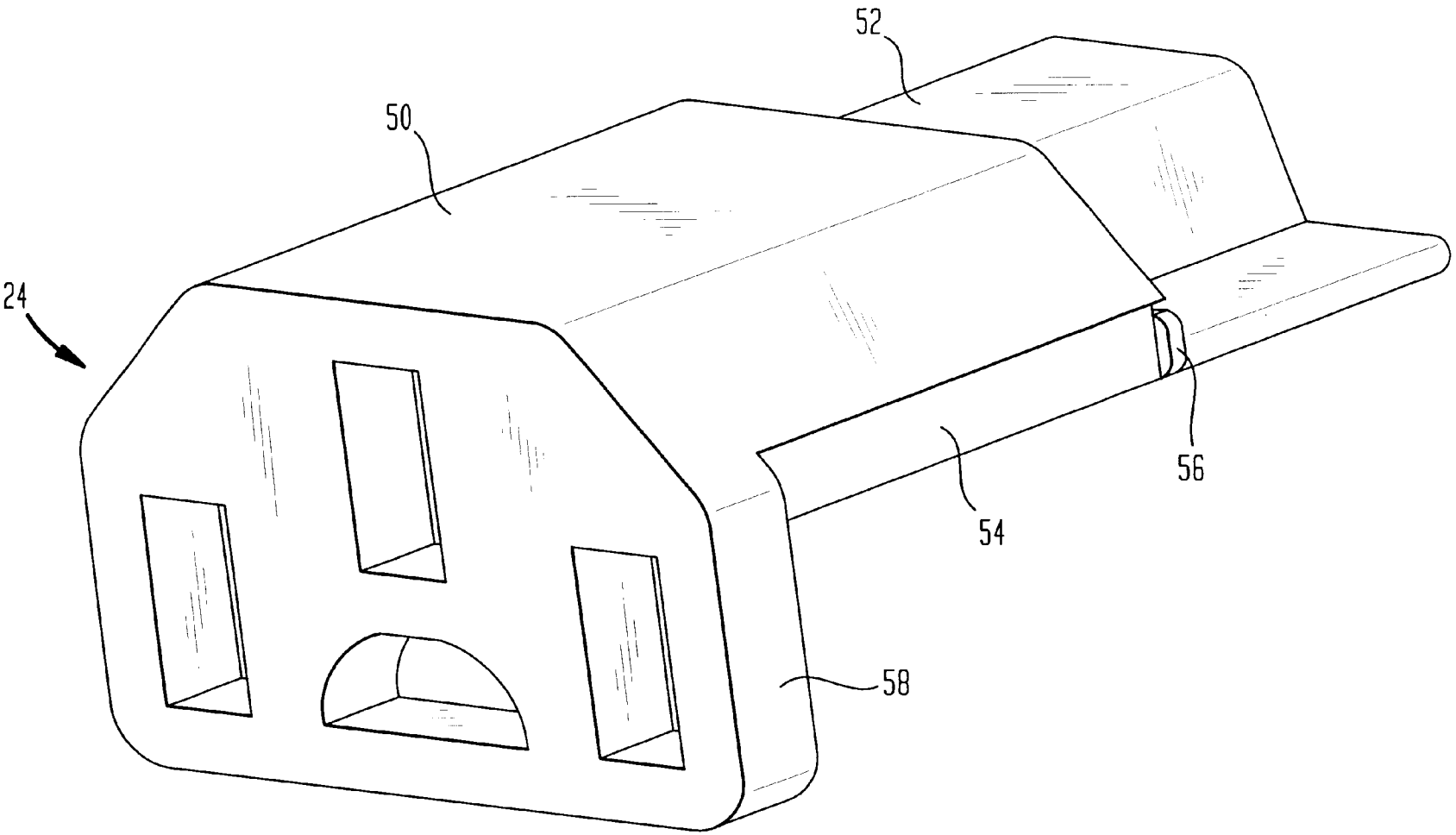
FIG. 4 is an enlarged perspective view of a top portion of the receptacle shown in FIG. 1.

FIG. 4 shows that the top portion 24 includes a anterior vault 50 and a posterior vault 52 with the anterior vault 50 covering the front channels 36 of the bottom portion 26 and the posterior vault 52 covering the rear channels 38 of the bottom portion 26. The top portion 24 has abutting side surfaces 54 that slidably engage an associated side wall 46 of the bottom portion 26. The side wall 46 is embraced between a stop 56 and a front flange 58 on the top portion 24. Accordingly, when the top portion 24 is snap-fitted to the bottom portion 26 with the side walls 46 in place between the stops 56 and front flange 58, the top portion 24 is restrained from sliding in longitudinal or axial direction relative to the bottom portion 26.

Figure 5:
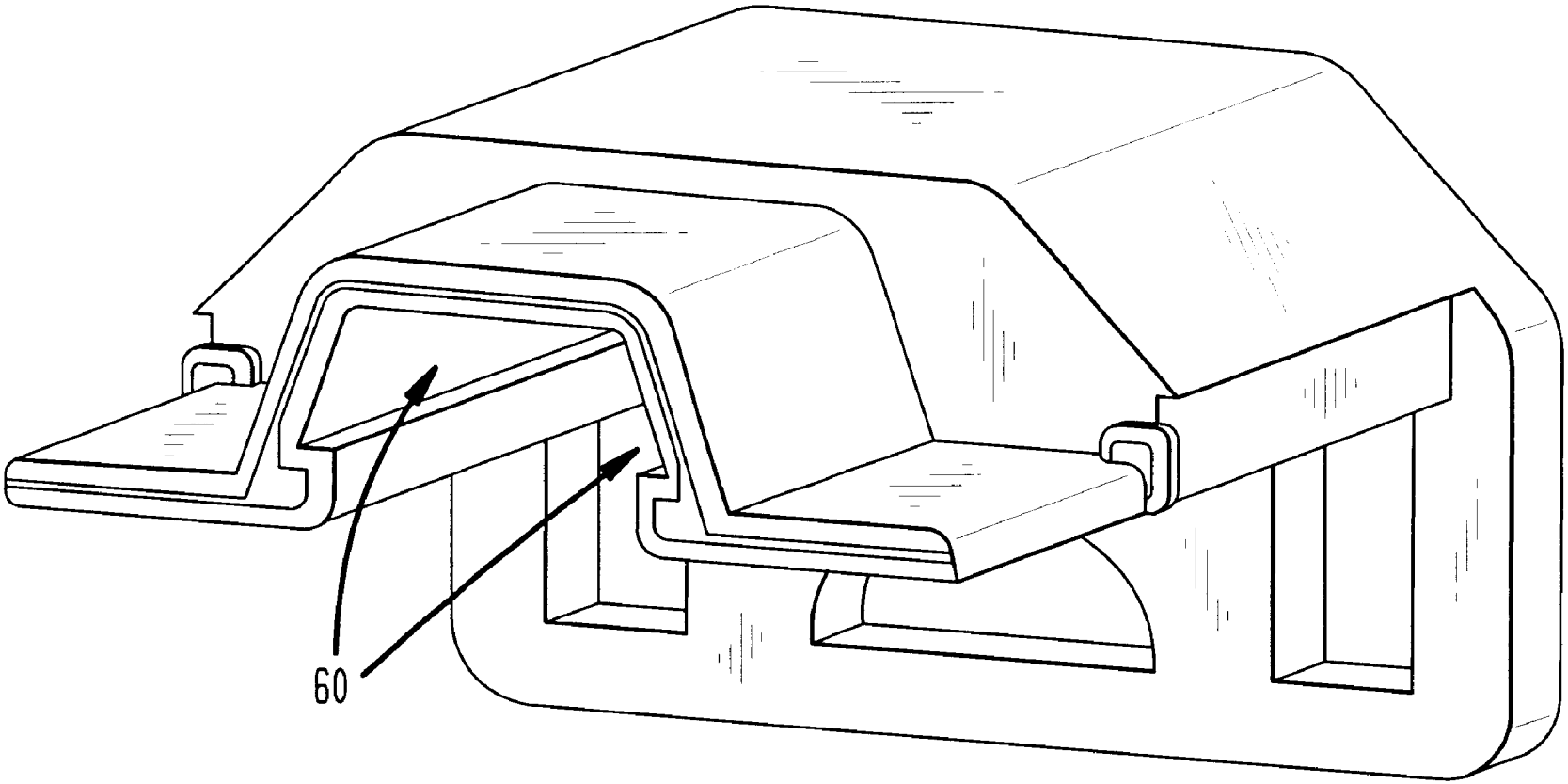
FIG. 5 is an enlarged perspective rear view of the receptacle portion shown in FIG. 4.

FIG. 5 shows the mating female channels 60 provided in the top portion 24, each of which snap-fittingly engages a corresponding locking ridge 44 extending from the central (i.e., ground) channels 36, 38 of the bottom portion 26. As can be appreciated, when the top portion 24 is snap-fitted to the bottom portion 26 of the receptacle 10, the parts are constrained relative to each other in the x, y and z directions if the material selected is sufficiently rigid, and it is very difficult to disassemble the receptacle 10 other than by destructive disassembly which overextends the elastic limit of the material.

To fabricate a receptacle 10, the conductors 28 are crimped to the wires 14 and then positioned in the channels 36, 38 of the bottom portion 26. The top portion 24 is then placed onto the bottom portion 26 and pressed down so that the locking ridges 44 enter into and engage their corresponding channels 60. Simultaneously, the sidewalls 46 engage the side surfaces 54 between the front flange 58 and the stops 56. The receptacle 10 can then be overmolded with an elastomer if desired. Alternatively, the receptacle 10 can be utilized without overmolding provided that the wires 14 entering the receptacle 10 are not subjected to excessive mechanical stresses or that an additional strain relief is provided at the rear of the receptacle to support the wires 14. All such variations and modifications are intended to be included within the scope of the invention.

What is claimed is:

1. A premold for housing a set of three electrical contacts of an electrical connector, the electrical contacts having an engageable portion and a connector end for connecting to an electric cord, comprising:

(a) a base having three channels extending from a front surface of said base to a rear surface thereof, each of said channels accommodating therein an associated one of the three electrical contacts, said front surface being proximate to a mating electrical connector when the electrical connector is used for making an electrical connection;

(b) an intermediate wall extending transversely across each of said channels dividing said channels into a front portion extending from said front surface to said intermediate wall and a rear portion extending from said intermediate wall to said rear surface, said front portion accommodating the engageable portion of the associated electrical contact and said rear portion accommodating the connector end of the associated electrical contact, said front portion and said rear portion shielding the associated electrical contact from inadvertent contact with the environment from a first direction; and (c) a cover fitting over said base, said cover covering said front portion and said rear portion of each of said channels and the associated electrical contacts contained therein for retaining the associated electrical contacts within said premold insulated from contacting each other and from contacting the environment from a second direction, said cover being substantially coextensive with said base such that each of the associated electrical contacts is substantially completely contained within the premold, said cover being constrained from moving relative to said base in the x, y and z directions, said three channels being arranged side-by-side, a central channel thereof having a pair of side walls each of which terminates at an upper edge thereof in a locking ridge which is receivable within a mating channel provided in said cover to retain said cover in association with said base.

2. The premold of claim 1, wherein each of said plurality of female electrical contacts has a bridge portion connecting said engageable portion with said connector end, and said intermediate wall of each of said channels has a surface relief therein for accommodating said bridge portion of an associated one of the female electrical contacts, the bridge portion extending over said intermediate wall within said surface relief.

3. The premold of claim 1, wherein said connector end is a crimp-type end.

4. The premold of claim 1, wherein said cover is divided into two portions, a first portion for covering said front portions of said channels, having a first volumetric capacity, and a rear portion for covering said rear portions of said channels, having a second volumetric capacity which is smaller than said first volumetric capacity.

5. The premold of claim 1, wherein said cover attaches to said base in a snap-fit relationship.

6. A premold for housing a set of three electrical contacts of an electrical connector, the electrical contacts having an engageable portion and a connector end for connecting to an electric cord, comprising:

(a) a base having three channels extending from a front surface of said base to a rear surface thereof, each of said channels accommodating therein an associated one of the three electrical contacts, said front surface being proximate to a mating electrical connector when the electrical connector is used for making an electrical connection;

(b) an intermediate wall extending transversely across each of said channels dividing said channels into a front portion extending from said front surface to said intermediate wall and a rear portion extending from said intermediate wall to said rear surface, said front portion accommodating the engageable portion of the associated electrical contact and said rear portion accommodating the connector end of the associated electrical contact, said front portion and said rear portion shielding the associated electrical contact from inadvertent contact with the environment from a first direction; and (c) a cover fitting over said base, said cover covering said front portion and said rear portion of each of said channels and the associated electrical contacts contained therein for retaining the associated electrical contacts within said premold insulated from contacting each other and from contacting the environment from a second direction, said cover being substantially coextensive with said base such that each of the associated electrical contacts is substantially completely contained within the premold, said cover being constrained from moving relative to said base in the x, y and z directions, said three channels being arranged side-by-side, two of said three channels on either side of a central channel having an exterior upstanding wall with a predetermined length and a predetermined thickness, said cover having a pair of reliefs on opposing sides of said cover, each of said reliefs having a length approximating said predetermined length and a depth approximating said predetermined thickness, and each of said reliefs receiving a corresponding said upstanding wall therein in slidable relationship for restraining said cover from moving relative to said base in a direction parallel to the direction of said channels.

7. The premold of claim 6, wherein said premold is for housing the electrical contacts of a female connector and further comprising a plurality of female electrical contacts, each having an engageable portion and a connector end, and wherein said cover has at one end thereof a flange extending at about 90 degrees relative to the direction of extension of said cover, said flange forming a cover to the front surface of said base and having a plurality of openings therein providing access to said female electrical contacts by a plurality of male electrical contacts which insert through said plurality of openings.

8. The premold of claim 7, wherein said flange has an opening therein for admitting an inflow of overmolding material.

* * * * *